US009970201B2

(12) United States Patent
Morozov

(10) Patent No.: US 9,970,201 B2
(45) Date of Patent: May 15, 2018

(54) INSIDE CORNER BACKER BOARD MOLDING INSERT

(71) Applicant: Oleg Morozov, Broken Arrow, OK (US)

(72) Inventor: Oleg Morozov, Broken Arrow, OK (US)

( * ) Notice: Subject to any disclaimer, the term of this patent is extended or adjusted under 35 U.S.C. 154(b) by 0 days. days.

(21) Appl. No.: 15/492,532

(22) Filed: Apr. 20, 2017

(65) Prior Publication Data

US 2017/0306634 A1 Oct. 26, 2017

Related U.S. Application Data

(60) Provisional application No. 62/324,909, filed on Apr. 20, 2016.

(51) Int. Cl.
*E04F 19/02* (2006.01)

(52) U.S. Cl.
CPC ..... *E04F 19/022* (2013.01)

(58) Field of Classification Search
CPC ... E04F 19/022; E04F 19/028; E04F 19/0436; E04B 9/303
USPC ..... 52/287.1, 288.1
See application file for complete search history.

(56) References Cited

U.S. PATENT DOCUMENTS 599,395 A * 2/1898 Liebreich ..... E04F 13/06 52/287.1
2,994,905 A * 8/1961 Franker, Jr. ..... E04F 19/0495 16/16
3,047,112 A * 7/1962 Tvorik ..... E04F 19/0436 52/254
3,201,910 A * 8/1965 Keesee ..... E04F 19/0436 424/DIG. 2
3,205,628 A * 9/1965 Frisk ..... E04B 9/306 160/354
3,222,837 A * 12/1965 Daley ..... A47K 3/008 52/250
4,052,830 A * 10/1977 Smith ..... E04F 19/04 52/288.1
4,189,888 A * 2/1980 Blitzer, Jr. ..... E04B 9/04 52/311.1
4,283,894 A * 8/1981 Raty ..... E04B 9/005 52/288.1

(Continued)

*Primary Examiner* — Brian E Glessner
*Assistant Examiner* — Adam G Barlow
(74) *Attorney, Agent, or Firm* — Global Intellectual Property Agency, LLC; Jordan Sworen

(57) ABSTRACT

An inside corner backer board molding insert is provided. The molding insert includes a body formed by a rigid member. An arcuate portion disposed on a front side of the body extends longitudinally from an upper face to a lower face of the body. The arcuate portion defines a concave surface extending laterally from a first longitudinal edge to a second longitudinal edge. A pair of laterally extending walls extend perpendicularly relative to each other and intersect forming a corner edge disposed on a rear side of the body. The corner edge forms a right angle sized to engage an inside corner of a wall. Opposing sides of the body interconnect the arcuate portion to the laterally extending walls and include a width sized to receive a backer board flush thereagainst. A lip extending outwardly from and edge of the opposing sides provides a support surface for the backer board.

9 Claims, 4 Drawing Sheets

(56) References Cited

U.S. PATENT DOCUMENTS

| | | | | | |
|---|---|---|---|---|---|
| 4,709,522 | A * | 12/1987 | Carnahan | E04F 19/0436 | 52/288.1 |
| 5,179,811 | A * | 1/1993 | Walker | E04F 19/0436 | 52/288.1 |
| 5,287,667 | A | 2/1994 | Singhal | | |
| 5,711,123 | A * | 1/1998 | Lamont | E04F 19/02 | 40/650 |
| 5,819,485 | A * | 10/1998 | Lane | E04F 19/0435 | 52/287.1 |
| 6,755,000 | B2 | 6/2004 | Hahn | | |
| 8,887,460 | B1 * | 11/2014 | Hoffman | E04F 19/0436 | 52/287.1 |
| 9,528,281 | B1 * | 12/2016 | Hoffman | E04F 19/0436 | |
| 2003/0115813 | A1 | 6/2003 | Hahn | | |
| 2005/0172571 | A1 * | 8/2005 | Koenig, Jr. | E04F 19/02 | 52/718.01 |
| 2005/0193664 | A1 * | 9/2005 | Koenig, Jr. | E04F 19/0436 | 52/287.1 |
| 2006/0277853 | A1 * | 12/2006 | Dillon | E04F 19/028 | 52/287.1 |
| 2010/0313498 | A1 * | 12/2010 | Paidar | E04F 19/0436 | 52/173.1 |
| 2013/0047533 | A1 | 2/2013 | Diener | | |

* cited by examiner

INSIDE CORNER BACKER BOARD MOLDING INSERT

CROSS REFERENCE TO RELATED APPLICATIONS

This application claims the benefit of U.S. Provisional Application No. 62/324,909 filed on Apr. 20, 2016. The above identified patent application is herein incorporated by reference in its entirety to provide continuity of disclosure.

BACKGROUND OF THE INVENTION

The present invention relates to molding inserts. More specifically, the present invention relates to a backer board molding insert configured to fit securely in an inside corner of a wall in order to install rounded corners when finishing a bathtub or shower wall with tile.

Tile used for the walls of a bathroom typically meet at the right angle formed by the inside corners of the wall, thus making it difficult to clean the corner. Inside corners are the corners that are formed by two intersecting walls with an angle of less than 180 degrees. Over time, the inside corner accumulates grime, soap scum, and hard water deposits, making the inside corners especially difficult to clean. Currently, there is no efficient or convenient means for forming a corner in a bathroom. Indeed, bathroom walls, such as bathtub and shower walls, typically do not include rounded corners because of the difficulty in forming and installing such rounded corners. One method currently employed to install rounded corners utilizes mud or pre-mixed joint compound to form a round corner. However, these type of compounds are disadvantageous in that they typically require sanding and are harder to acquire a smooth finish, which is critical in the formation and installation of a round corner. Therefore, there is a need for an inside corner backer board molding insert for installing rounded corners in bathrooms.

SUMMARY OF THE INVENTION

In view of the foregoing disadvantages inherent in the known types of molding inserts now present in the prior art, the present invention provides an inside corner backer board molding insert wherein the same can be utilized for providing convenience for the user when installing rounded or curved corners in a bathroom.

An example of the present invention comprises a body including an arcuate portion disposed on a front side of the body that extends longitudinally from an upper face of the body to a lower face of the body, wherein the arcuate portion defines a concaved surface extending laterally from a first longitudinal edge to a second longitudinal edge, a pair of laterally extending walls that extend perpendicularly relative to each other and intersect forming a corner edge disposed on a rear side of the body, wherein the corner edge forms a right angle sized to engage an inside corner of a wall, opposing sides that interconnect the arcuate portion to the laterally extending walls and include a width sized to receive a backer board flush thereagainst, and a lip extending outwardly from an edge of the opposing sides for providing a support surface for the backer board.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
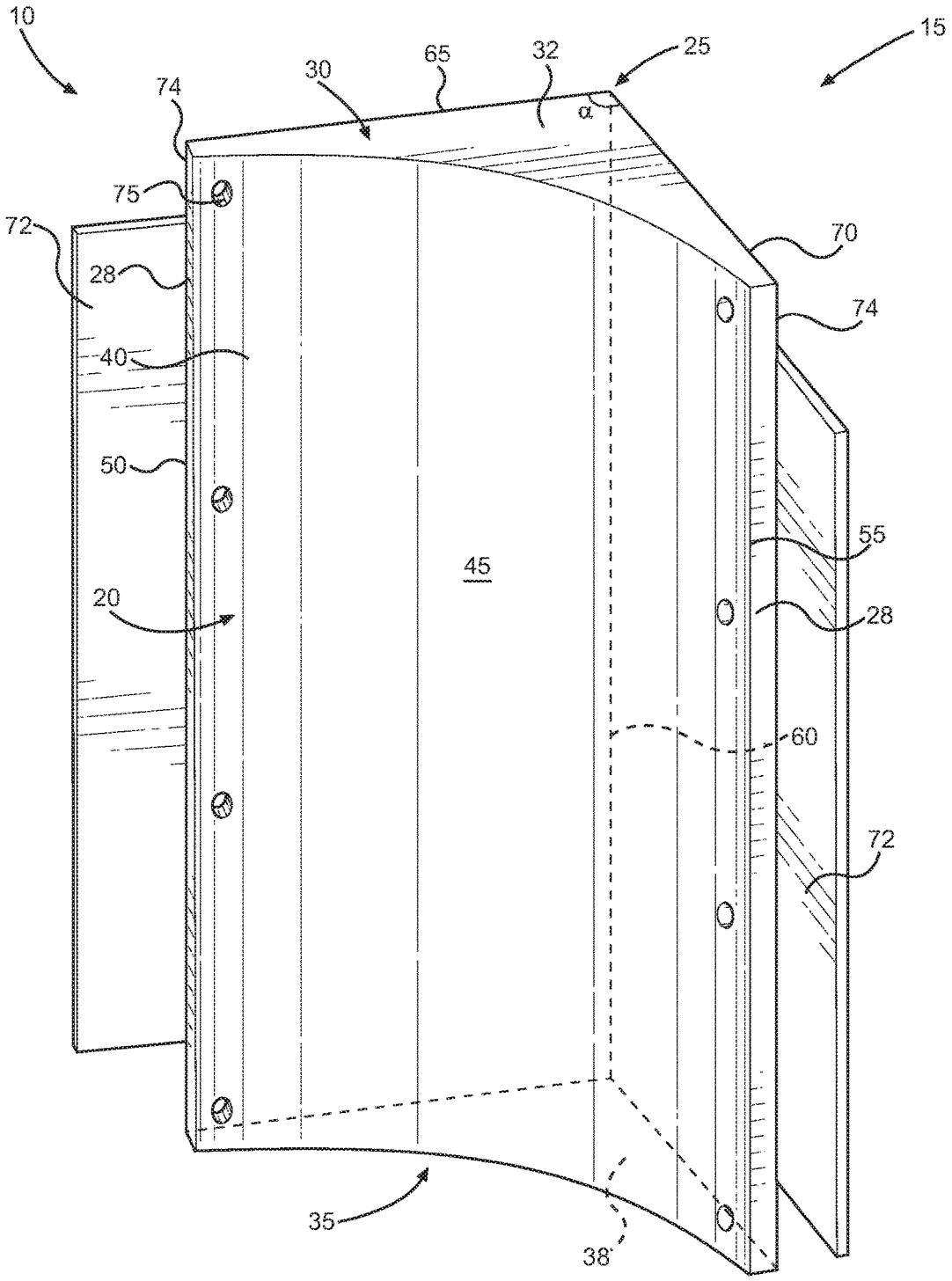
FIG. 1 shows a front perspective view of the molding insert.

Reference is made herein to the attached drawings. Like reference numerals are used throughout the drawings to depict like or similar elements of the inside corner backer board molding insert. The figures are intended for representative purposes only and should not be considered to be limiting in any respect.

Figure 2:
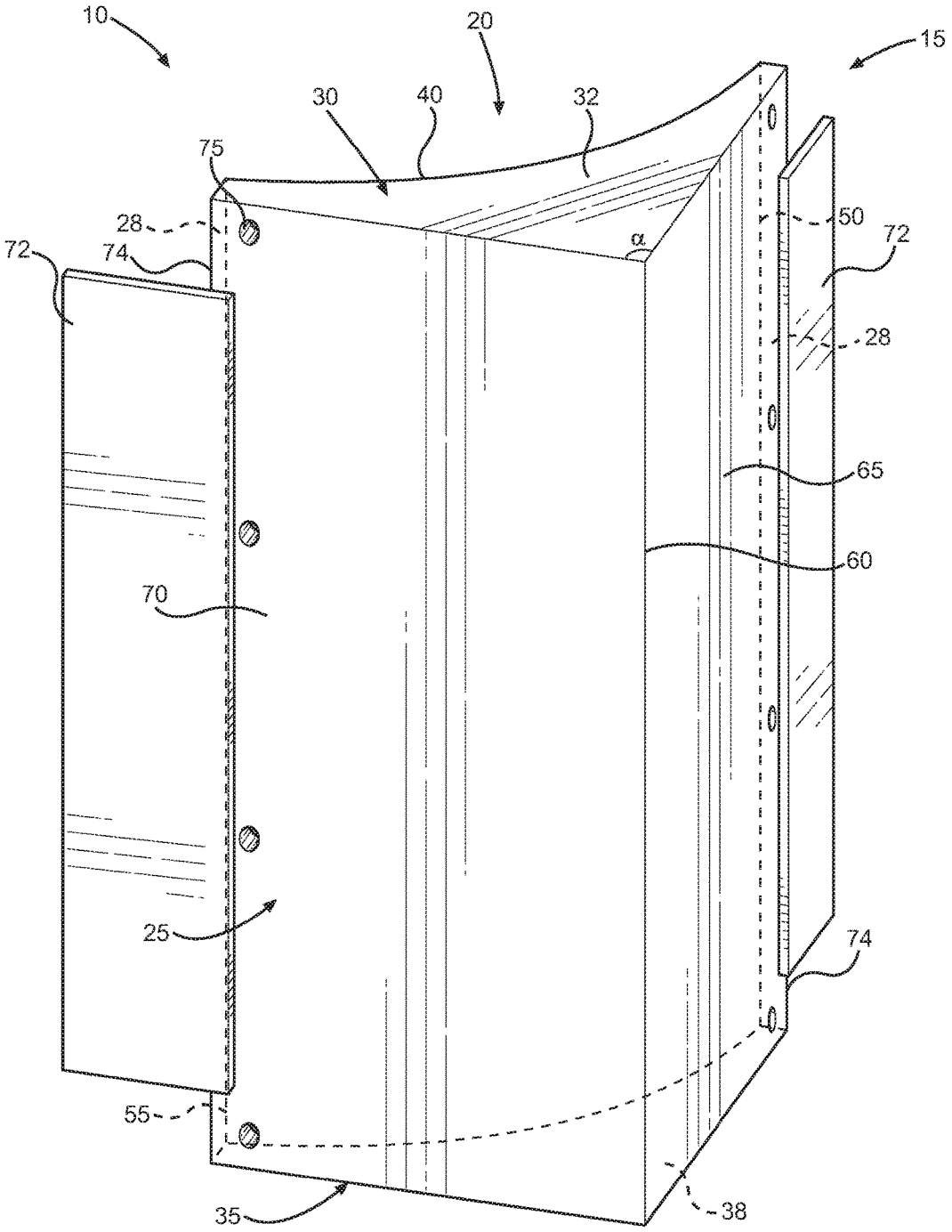
FIG. 2 shows a rear perspective view of the molding insert.
Figure 3:
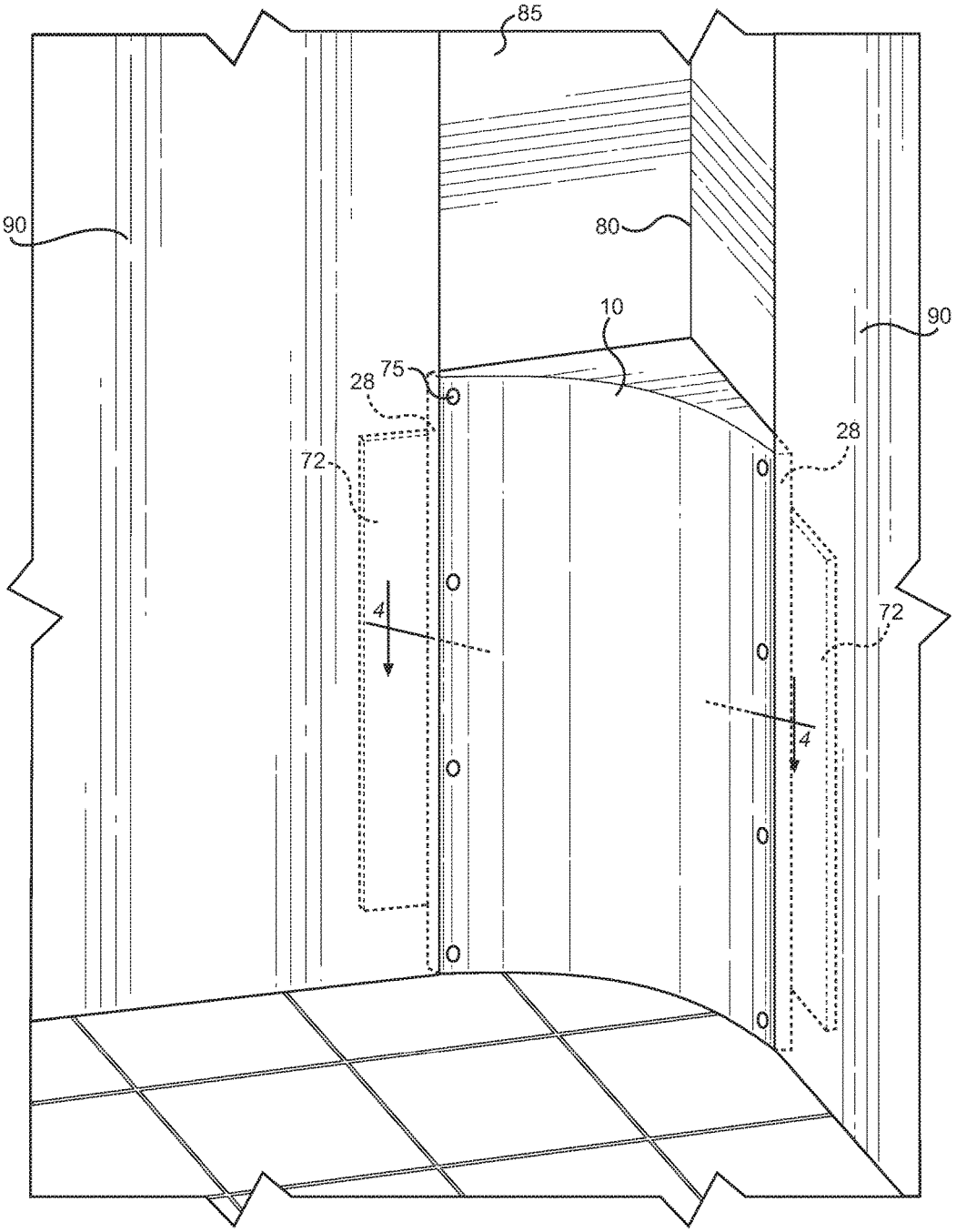
FIG. 3 shows a perspective view of the molding insert in use.
Figure 4:
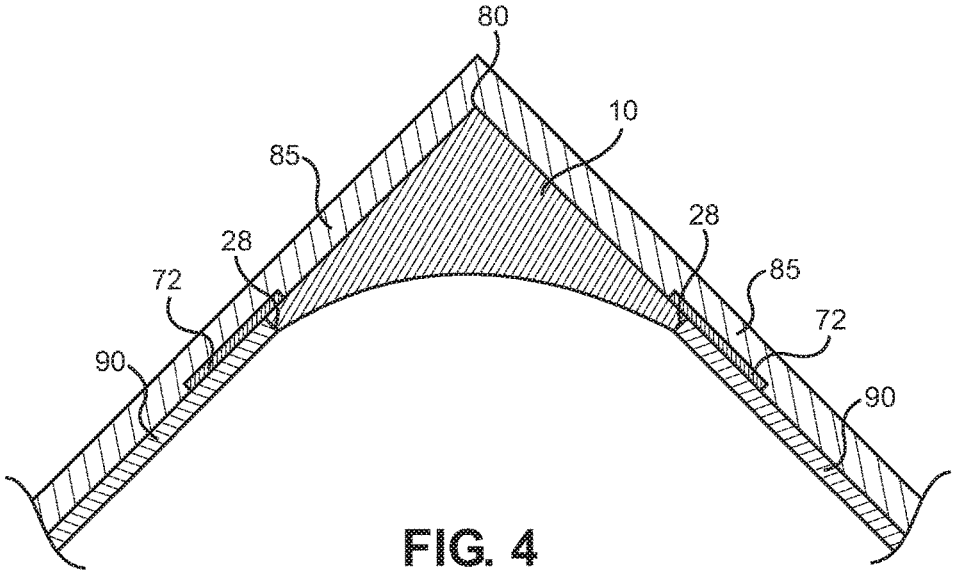
FIG. 4 shows a cross-sectional view of the molding insert of FIG. 3 along the line 4-4.

Referring now to FIGS. 1 and 2, there are shown front and rear perspective views of the molding insert, respectively. The present invention comprises a molding insert 10 including an elongated body 15 configured to be nestled in the inside corner of a bathroom wall during the installation of backer board when remodeling the bathroom, as illustrated by FIGS. 3 and 4. The molding insert 10 facilitates the conversion of the inside corner into a curved corner during the remodeling for the purpose of removing the-hard-to-reach right angled inside corners of a bathroom, and/or angled inside corners entirely.

The elongated body 15 includes a rigid unitary member having a front side 20, a rear side 25, opposing first and second sides 28, a first end 30 defining an upper face 32, and a second end 35 defining a lower face 38. In the depicted embodiment, the body 15 includes a length greater than its width. However, in an alternative embodiment, the body 15 may include a length less than or equal to its width. The body 15 may be constructed of a plastic material, such as polyethylene (PE), Acrylonitrile butadiene styrene (ABS), Polypropylene (PP), Polyoxmethylene (POM), Polycarbonate (PC), and Polyvinyl chloride (PVC), by injection molding. However, in alternative embodiments, other processes and/or materials, such as hard foam, concrete, metal, and the like may be used. The upper and lower faces 32 and 38 include planar surfaces configured to rest flush on a surface in order to maintain the body 15 in an upstanding longitudinal position and to facilitate the stacking of another molding insert 10 thereon.

An arcuate portion 40 disposed on the front side 20 extends longitudinally from the upper face 32 of the body 15 to the lower face 38 of the body 15. The arcuate portion 40 defines a concave surface 45 on the front side 20 that extends laterally from a first longitudinal edge 50 to a second longitudinal edge 55. The first and second longitudinal edges 50, 55 extend parallel relative to each other. The concave surface 45 includes a smooth surface for facilitating the mounting of tile thereon.

A corner edge 60 disposed on the rear side 25 of the body 15 extends longitudinally from the upper face 32 of the body 15 to the lower face 38 of the body 15. The corner edge 60 is configured to engage the inside corner of a bathroom wall, as illustrated in FIGS. 3 and 4. The corner edge 60 is formed by the intersection of a first lateral wall 65 and a second lateral wall 70 disposed on the rear side 25 of the body 15.

The first and second lateral walls 65, 70 extend longitudinally from the upper face 32 to the lower face 38 and are perpendicular relative to each other. In the depicted embodiment, the first and second lateral walls 65, 70 form an interior right angle α at the corner edge 60 on both the upper and lower faces 32, 38. The interior right angle α of the corner edge 60 is complimentary to the angle formed by an inside corner of a wall. In this way, the corner edge 60 may nestle within the insider corner of the wall while the first and second lateral walls 65, 70 rest flush against the adjacent walls that form the inside corner, as illustrated in FIG. 4. The angle of the corner edge 60, however, is not limited to a right angle. Indeed, in alternative embodiments, the first and second lateral walls 65, 70 form angles at the corner edge which including varying degrees in order to nestle within inside corners having more acute or obtuse angles.

The opposing first and second sides 28 extend longitudinally along the body 15 and interconnect the arcuate portion 40 to the first and second lateral walls 65, 70. The first and second opposing sides 28 extend parallel relative to each other and include a width complimentary to the width of conventional backer board, such as cementitious, coated glass mat, fiber cement, and/or fiber-reinforced gypsum backer boards. The width of the sides 28 is complimentary insofar as a backer board abutted thereagainst aligns flush with the first and second opposing sides 28, such that the backer board forms a continuous surface with the concave surface 45 of the body 15, as illustrated by FIG. 4. In this way, the molding insert 10 facilitates the formation of a smooth surface with the backer board when finishing the wall with tile.

A lip 72 disposed along a back edge 74 of the first and second opposing sides 28 is configured to provide a support surface for backer board that is placed against the first and second opposing sides 28. The lip 72 protrudes outwardly from the back edge 74 and extends longitudinally along the first and second opposing sides 28, such that the lip 72 is stepped relative to the surface of the first and second opposing sides 28 and the surface of the first and second lateral walls 65, 70. In the depicted embodiment, the lip 72 is positioned centrally along the back edge 74 of the first and second opposing sides 28 and extends only partially therealong, e.g., it does not extend entirely from the upper face 32 of the body 15 to the lower face 38 of the body 15 and includes a length less than a length of the first and second opposing sides 28. Further, in the depicted embodiment, the lip 72 extends past the back edge 74 and partially onto the first and second lateral walls 65, 70. In this way, the lip 72 provides further support to backer board place against the first and second opposing sides 28. In another embodiment, the lip 72 extends the length of the first and second opposing sides 28 from the upper face 32 to the lower face 38 and includes a length equal to the length of the first and second opposing sides 28. In alternative embodiments, the lip 72 is positioned offset relative to a center of the first and second opposing sides 28.

One or more apertures 75 disposed along the first and second longitudinal edges 50, 55 of the body 15 extend from through the body 15 from the front side 20 to the rear side 25. The apertures 75 are sized to receive a fastener, such as a nail or screw, therethrough in order to fasten the body 15 to the inside corner of a wall. In the depicted embodiment, the body 15 includes eight apertures 75, with four apertures 75 disposed on each of the first and second longitudinal edges 50, 55 such that the apertures 75 are evenly spaced apart.

Referring now to FIGS. 3 and 4, there is shown a perspective view of the molding insert in use and a cross-sectional view of the molding insert of the FIG. 3 along the line 4-4, respectively. In one use of the present invention, a user nestles the corner edge of the body in the inside corner 80 of a wall 85. The user than fastens the molding insert 10 to the inside corner 80 via a fastener inserted through each of the apertures 75. The user may stack as many molding inserts 10 onto one another as necessary to completely cover the insider corner 80 of the wall 85. Next, the user places backer board 90 on the lip 72 and aligns the backer board 90 with the sides 28 of the molding insert 10. The backer board 90 is then ready to be mounted onto the wall 85, resulting in a flush alignment between the molding insert 10, wall 85, and backer board 90, as illustrated in FIG. 4. This flush alignment forms a smooth curved corner in place of the inside corner 80, thereby enabling a user to finish the now curved corner with tile.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A molding insert, comprising:

a body including a front side, a rear side, an upper face, and a lower face;

an arcuate portion disposed on the front side, the arcuate portion extending longitudinally from the upper face to the lower face, the arcuate portion defining a concave surface extending laterally from a first longitudinal edge to a second longitudinal edge;

a plurality of apertures disposed on the concave surface and extending through to the rear side of the body;

a first lip including a first portion attached to a first wall of the rear side and a second portion extending laterally outwardly past the first longitudinal edge;

a second lip including a first portion attached to a second wall of the rear side and a second portion extending laterally outwardly past the second longitudinal edge;

a corner edge disposed on the rear side, the corner edge extending longitudinally from the upper face to the lower face, the corner edge sized to nestle in an inside corner of a wall; and a pair of opposing sides extending longitudinally along the body, the pair of opposing sides including a width sized to receive an edge of a backer board flush thereagainst.

2. The molding insert of claim 1, wherein the plurality of apertures comprises a first group of apertures arranged linearly and disposed along the first longitudinal edge and a second group of apertures arranged linearly and disposed along the second longitudinal edge.

3. The molding insert of claim 1, wherein the first lip and the second lip include a length less than a length of the first and second opposing sides and are positioned centrally along the first and second opposing sides, respectively.

4. The molding insert of claim 1, wherein the lip is stepped relative to a surface of the first and second opposing sides.

5. The molding insert of claim 1, wherein the body is composed of a rigid unitary member.

6. The molding insert of claim 1, wherein the concave surface includes a smooth texture.

7. The molding insert of claim 1, wherein the corner edge forms an interior right angle sized to engage the angle formed by the inside corner of the wall.

8. The molding insert of claim 7, further comprising a first laterally extending wall and a second laterally extending wall, the first and second laterally extending walls extending perpendicularly relative to each other and intersecting at the corner edge to form the interior right angle.

9. The molding insert of claim 8, wherein the pair of opposing sides interconnect the arcuate portion to the first and second laterally extending walls.

* * * * *